United States Patent [19]

Greco

[11] Patent Number: 4,644,669

[45] Date of Patent: Feb. 24, 1987

[54] TOELESS SLIPPER

[76] Inventor: Margaret Greco, 6847 Overlook Dr., Ft. Myers, Fla. 33907

[21] Appl. No.: 790,504

[22] Filed: Oct. 23, 1985

[51] Int. Cl.[4] ..... A43B 1/02; A43B 3/12

[52] U.S. Cl. ..... 36/9 R; 36/11.5

[58] Field of Search ..... 36/9 R, 11.5, 7.1 R, 36/7.5, 30 R, 110

[56] References Cited

U.S. PATENT DOCUMENTS

| | | | |
|---|---|---|---|
| 2,252,315 | 8/1941 | Doree | 36/9 R |
| 2,287,744 | 6/1942 | Monahan | 36/7.5 |
| 2,299,500 | 10/1942 | Sawyer | 36/11.5 |
| 2,404,083 | 7/1946 | Murray | 36/11.5 |
| 2,490,916 | 12/1949 | Miller | 36/9 R |
| 2,751,693 | 6/1956 | Baker | 36/11.5 |
| 2,926,434 | 3/1960 | Morgan | 36/11.5 |
| 3,002,297 | 10/1961 | Neilson | 36/11.5 |
| 3,221,422 | 12/1965 | Lemeshnik | 36/30 R |
| 3,345,762 | 10/1967 | Fisher et al. | 36/9 R |
| 3,399,470 | 9/1968 | Schofield | 36/7.1 R |
| 4,254,563 | 3/1981 | Bruno | 36/9 R |
| 4,275,512 | 6/1981 | Zeligman et al. | 36/11.5 |

FOREIGN PATENT DOCUMENTS

| | | | |
|---|---|---|---|
| 145928 | 1/1936 | Fed. Rep. of Germany | 36/11.5 |
| 672828 | 2/1939 | Fed. Rep. of Germany | 36/7.5 |

OTHER PUBLICATIONS

"Construction of the Quickie Sandal", Dec. 1972.

*Primary Examiner*—Werner H. Schroeder
*Assistant Examiner*—Steven N. Meyers
*Attorney, Agent, or Firm*—Charles J. Prescott; Raymond H. Quist

[57] ABSTRACT

A slipper designed to leave the wearer's toes exposed for enjoyment or for treatment such as a pedicure is provided. The slipper has a sole which may be of flexible and pliable material or may be relatively rigid. A cushioned insole may also be used and connected to the sole. At the margin of the rear portion of the sole, a heel containing means is connected. The heel containing means is formed of a fold of material with the fold being joined to the sole. The free edges of the heel containing means are seamed together while also forming a passage for a tying cord or ribbon. The tying cord or ribbon is made captive in the passage by stitching it to the heel containing means at one point to prevent inadvertant removal of the cord or ribbon therefrom. An adjustable strap is connected to the margins of the sole so as to extend across the instep of the wearer.

6 Claims, 4 Drawing Figures

TOELESS SLIPPER

BACKGROUND OF THE INVENTION

1. Field of the Invention

This invention relates generally to footwear and more particularly to a slipper which can be worn on feet of various sizes and will leave the toes of the wearer exposed.

2. Description of Related Art

In preparation for treatments involving the toes such as pedicures, it is necessary for the individual to remove street shoes and stockings. Disposable paper sandals of the scuff type which depend upon an enclosed toe portion to keep them in place are sometimes given for temporary use while awaiting treatment, but these are removed so as to have access to the toes during treatment. The paper scuffs also provide essentially no insulation against cold floors and are unattractive thereby detracting from, rather than adding to, the feeling of well being which should accompany having a pedicure.

U.S. Pat. No. 2,926,434 by T. P. Morgan, entitled "Slipper Type Article of Footware", discloses a slipper having a tying arrangement which permits one size slipper to be used on various sized feet. This slipper has a closed toe, however, and could not be used during treatment of the toes.

U.S. Pat. No. 905,432 by E. A. Jennings, entitled "Folding Slipper", discloses a slipper which may be folded flat, but also has an enclosed toe.

U.S. Pat. No. 2,252,315 by S. Dore'e, entitled "Scuff", discloses a scuff having an elastic strap for holding the scuff heel in position and a closed toe.

A number of U.S. patents disclose the use of adjustable straps employing multiple hooks and complementary loops such as U.S. Pat. No. 4,458,431 by S. E. Sinclair, entitled "Boot for Pet Animal; U.S. Pat. No. 3,769,722 by J. G. Rhee, entitled "Protective Shoe"; U.S. Pat. No. 3,626,610 by R. Dassler entitled "Sport Shoe"; U.S. Pat. No. 4,114,297 by J. P. Famolare, Jr., entitled "Cinching Enclosure"; and U.S. Pat. No. 4,275,513 by A. J. Antonious, entitled "Adjustable and Flexible Closure Assembly for Monk Style Shoes". None of these patents discloses or suggests a toeless shoe or slipper.

It is therefore an object of this invention to provide a slipper which need not be removed during treatment of the toes of the wearer.

It is a further object of this invention to provide a toeless slipper which permit one sized slipper to be worn on feet of various sizes.

It is also an object of this invention to provide a toeless slipper which can be laundered.

It is also an object of this invention to provide a toeless slipper which will be comfortable to wear and attractive in appearance so that a fastidious person will be pleased to wear the slipper.

SUMMARY OF THE INVENTION

A slipper is provided which has an elongated sole and which may also have a cushioned insole. A heel portion extends up and around the heel of the wearer and has tying means extending from the anterior ends of the heel portion for fastening about the ankle of the wearer. One or more adjustable straps extend across the instep of the wearer. The sole is sufficiently flexible to permit the person treating the toes to reach between the sole or insole and the toes. In at least one embodiment all materials in the slipper can be laundered.

DETAILED DESCRIPTION OF THE INVENTION

Figures 1, 2, 3, 4:
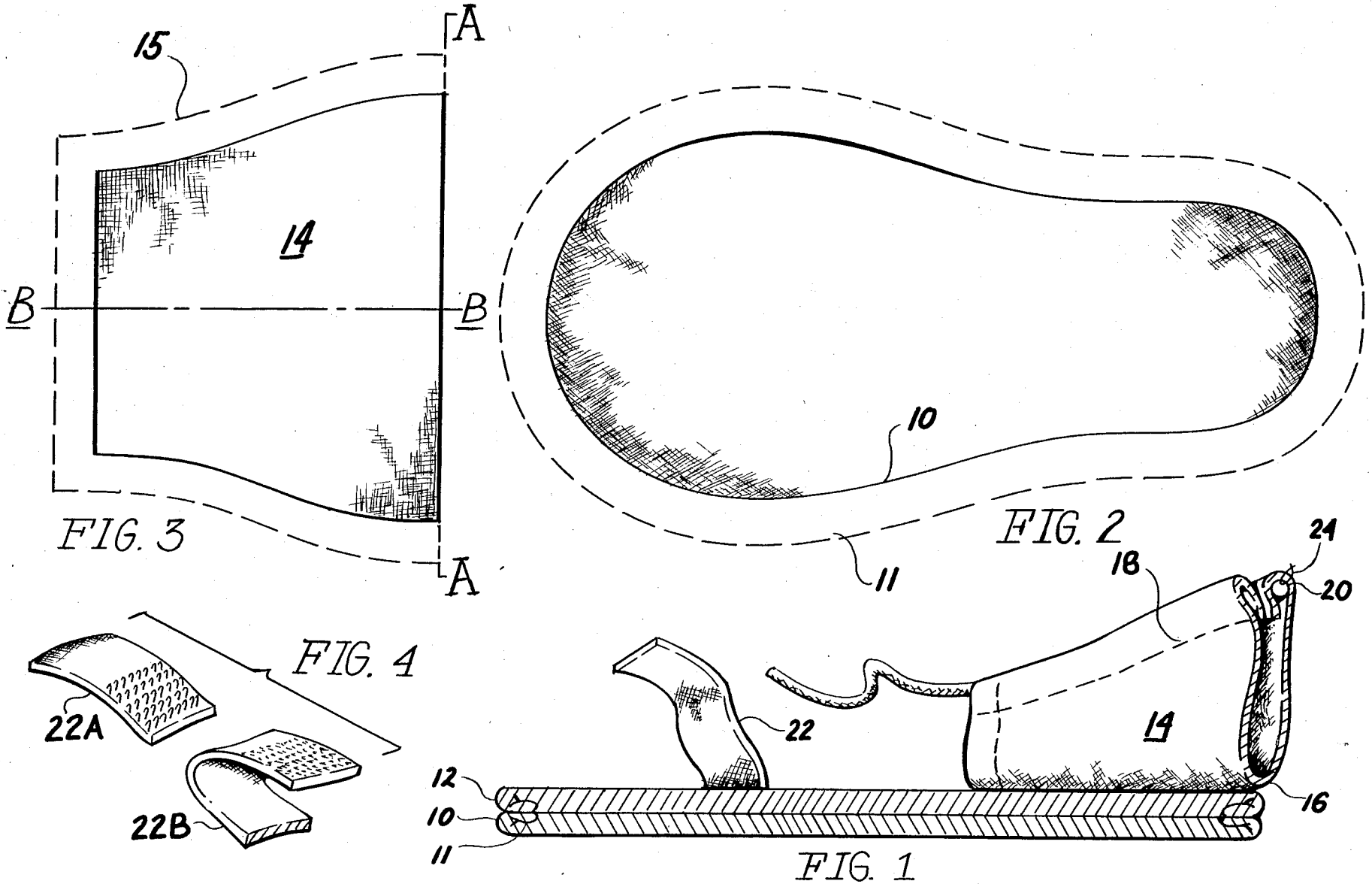
FIG. 1 is an elevation in cross-section along the longitudinal axis of a toeless slipper in accordance with the invention.
FIG. 2 represents a pattern for the sole or insole of the toeless slipper in accordance with the invention.
FIG. 3 represents one-half of a pattern for the heel of the toeless slipper having an axis of symmetry A—A in accordance with the invention.
FIG. 4 is a detail of an adjustable strap in accordance with the invention.

Referring to FIG. 1, the slipper of this invention is shown in cross-section as having an elongated sole 10 extending the full length of the slipper. Sole 10 may be made of a relatively flexible and pliable material such as terry cloth where the slipper is to be worn indoors and not exposed to rough flooring. It is also contemplated that a slipper of the same design could have a sole 10 of relatively rigid material such as leather or a composite shoe sole material. Where the sole is made of relatively flexible and pliable material, a pattern such as that shown in FIG. 2 may be used to define sole 10 with the associated seam allowance 11. In many cases it will be found desirable to have a soft insole 12, for example of quilted, padded material, attached to sole 10 by stitching, for example, providing not only cushioning but also thermal insulation. Such an insole may not be needed if the flooring is carpeted.

Heel containing means 14 is attached to the margin of the rear portion of the sole and extends upwardly from the sole. (Because FIG. 1 is in cross-section, only one-half of the heel containing means is seen.) Heel containing means 14 may be formed from a double thickness of material by folding the material and attaching the fold 16 to sole 10 or insole 12 as by stitching. FIG. 3 shows a pattern for the heel containing means 14 with its seam allowance 15. The pattern of FIG. 3 is for one half the heel containing means with line A—A indicating the division of the halves. The line B—B is the fold line for heel containing means 14. The loose ends of heel containing means 14 are folded in and seamed together along the line 18, while at the same time enclosing tying cord 20. While tying cord 20 is shown as having a circular cross-section, it could be of another configuration such as a flat ribbon. Tying cord 20 extends from the anterior ends of the upper margin of heel containing means 14. It has been found that a tying cord of about 29 inches is satisfactory and a stitch 24 at the anterior portion of heel containing means 14 serves to keep tying cord 20 captive. It will be appreciated that even though heel containing means 14 is made to encompass a fairly large heel, by virtue of tying cord 20 it can be drawn snugly about a relatively smaller heel.

At the front portion of the sole is provided adjustable strap 22 which is connected at the margin of sole 10 or insole 12, if an insole is used. Strap 22 extends across the instep portion of the wearer's foot so as to retain the sole against the bottom of the wearer's foot. Although a single strap 22 is shown, more than one may be used if desired. Strap 22 may be of elastic material, or, as shown in FIG. 4, strap 22 may be formed of two parts 22A having a multiplicity of loop elements thereon, and 22B having a multiplicity of hook or barb elements thereon.

The toeless slipper which has been described may be made entirely of materials which can be laundered, so that the slipper can be laundered after each use. The heel containing means 14 not only serves the functional purpose of helping to hold the slipper on the wearer's foot, but it also tends to eliminate the slight embarrassment of having a completely bare foot when others are shod, i.e. it tends to put the wearer more at ease.

Although a preferred embodiment of a toeless slipper has been illustrated and described, it will be apparent to those skilled in the art that modifications may be made. It is intended that the appended claims cover all such modifications falling within the spirit of the invention and the scope of the claims.

I claim:

1. A toeless slipper comprising:

an elongated sole having a front portion and a rear portion and said sole extending the full length of said slipper;

an elongated insole coextensive with said sole;

said sole and said insole being sewed together along their margins;

heel containing means formed from a fold of material and connected at said fold to, and extending upwardly from, the margin of said rear portion of said sole and insole;

tying means extending from the anterior ends of the upper margin of said heel containing means;

the free edges of said fold of material being stitched to provide a passage through said heel containing means for said tying means; and an adjustable strap formed of two pieces having mating, releasably interconnecting means thereon, with said pieces connected on opposite sides of the margin of said front portion of said sole and insole and extending across the instep portion of the wearer's foot for retaining the front portion of said insole against the bottom of the wearer's foot.

2. A toeless slipper in accordance with claim 1 wherein:

said sole is formed of a substantially impervious material.

3. A toeless slipper in accordance with claim 1 wherein:

said sole is relatively rigid.

4. A toeless slipper in accordance with claim 1 wherein:

said sole is relatively flexible and pliable.

5. A toeless slipper in accordance with claim 1 wherein:

the materials forming said slipper can be laundered.

6. A slipper designed to leave the wearer's toes exposed for treatment comprising:

an elongated sole having a front portion and a rear portion and extending the full length of said slipper;

said sole formed of relatively flexible and pliable material and having a seam allowance;

an elongated insole coextensive with said sole;

said insole formed of padded material and having a seam allowance;

said sole and said insole being sewed together along their margins with said seam allowances of said sole and said insole being contained between said sole and said insole;

heel containing means formed from a fold of material and connected at said fold to the margin of said rear portion of said sole;

tying means extending from the anterior ends of the upper margin of said heel containing means;

the free ends of the material forming said heel containing means including a seam allowance contained between said fold and stitched to form a passage for said tying means;

said tying means made captive in said passage by having at least one stitch connecting said tying means to said heel containing means; and at least one adjustable strap connected at each end along the margin of said front portion of said sole and extending across the instep portion of the wearer's foot, whereby said sole will be retained against the bottom of the wearer's foot while leaving the wearer's toes exposed for treatment.

* * * * *